US011149953B2

(12) United States Patent
Cerutti

(10) Patent No.: US 11,149,953 B2
(45) Date of Patent: Oct. 19, 2021

(54) METHOD FOR REDUCING $NO_x$ EMISSION IN A GAS TURBINE, AIR FUEL MIXER, GAS TURBINE AND SWIRLER

(71) Applicant: Nuovo Pignone Srl, Florence (IT)

(72) Inventor: Matteo Cerutti, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 756 days.

(21) Appl. No.: 15/519,629

(22) PCT Filed: Oct. 16, 2015

(86) PCT No.: PCT/EP2015/073985
§ 371 (c)(1),
(2) Date: Apr. 17, 2017

(87) PCT Pub. No.: WO2016/059200
PCT Pub. Date: Apr. 21, 2016

(65) Prior Publication Data

US 2017/0241645 A1 Aug. 24, 2017

(30) Foreign Application Priority Data

Oct. 17, 2014 (IT) ..... CO2014A000032

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC .. F23R 3/14; F23R 3/286; F23R 3/343; F23R 3/28; F23D 11/103; F23D 2900/14021; F23D 2900/14071
See application file for complete search history.

(56) References Cited

U.S. PATENT DOCUMENTS 5,251,447 A 10/1993 Joshi et al.
5,351,447 A 10/1994 Grauert
(Continued)

FOREIGN PATENT DOCUMENTS

JP 11337068 A 12/1999
JP 2009052877 A 3/2009
(Continued)

OTHER PUBLICATIONS

First Office Action and Search issued in connection with corresponding CN Application No. 201580055660.2 dated Nov. 29, 2018 (English Translation Not Available).
(Continued)

*Primary Examiner* — Todd E Manahan
*Assistant Examiner* — Thuyhang N Nguyen
(74) *Attorney, Agent, or Firm* — Baker Hughes Patent Org.

(57) ABSTRACT

A method for reducing NOx emissions in a gas turbine in which a flow of primary air and a flow of fuel are fed into a dual annular counter rotating swirler, the primary air flow being fed into the inner and outer annular chambers, wherein the method comprises the step of injecting the flow of fuel into the inner annular chamber; another embodiment is a gas turbine air fuel mixer comprising a dual annular counter rotating swirler comprising a fuel supplying element adapted to supplying fuel inside the inner chamber of the swirler; another embodiment is a gas turbine provided by such air fuel mixer.

18 Claims, 5 Drawing Sheets

(56) References Cited

U.S. PATENT DOCUMENTS

| | | | | |
|---|---|---|---|---|
| 5,351,477 | A * | 10/1994 | Joshi | F23C 7/004 239/400 |
| 5,511,375 | A | 4/1996 | Joshi et al. | |
| 5,551,375 | A | 9/1996 | Flores | |
| 5,613,363 | A | 3/1997 | Joshi et al. | |
| 5,675,971 | A * | 10/1997 | Angel | F23R 3/286 239/405 |
| 5,680,766 | A | 10/1997 | Joshi et al. | |
| 5,778,676 | A * | 7/1998 | Joshi | F23D 11/101 239/405 |
| 8,646,275 | B2 * | 2/2014 | Rackwitz | F23R 3/343 60/737 |
| 9,115,896 | B2 * | 8/2015 | Abdel-Hafez | F23C 7/004 |
| 2001/0052229 | A1 | 12/2001 | Tuthill et al. | |
| 2005/0268618 | A1 | 12/2005 | Johnson et al. | |
| 2007/0289306 | A1 | 12/2007 | Suria et al. | |
| 2009/0056336 | A1 * | 3/2009 | Chila | F23R 3/14 60/737 |
| 2009/0100837 | A1 | 4/2009 | Von Der Bank | |
| 2010/0180599 | A1 | 7/2010 | Thomas et al. | |
| 2010/0236252 | A1 | 9/2010 | Huth | |
| 2013/0086910 | A1 * | 4/2013 | Khan | F23R 3/14 60/737 |
| 2013/0283805 | A1 | 10/2013 | Zuo | |
| 2014/0033722 | A1 | 2/2014 | Abdel-Hafez et al. | |
| 2016/0209040 | A1 * | 7/2016 | Tamura | F23R 3/32 |

FOREIGN PATENT DOCUMENTS

| | | | |
|---|---|---|---|
| JP | 2013231582 | A | 11/2013 |
| SU | 1430685 | A1 | 10/1988 |
| SU | 1688051 | A1 | 10/1991 |

OTHER PUBLICATIONS

Italian Search Report and Written Opinion issued in connection with corresponding IT Application No. CO2014A0032 dated Jun. 12, 2015.

International Search Report and Written Opinion issued in connection with corresponding PCT Application No. PCT/EP2015/073985 dated Jan. 13, 2016.

International Preliminary Report on Patentability issued in connection with corresponding PCT Application No. PCT/EP2015/073985 dated Apr. 18, 2017.

* cited by examiner

METHOD FOR REDUCING $NO_x$ EMISSION IN A GAS TURBINE, AIR FUEL MIXER, GAS TURBINE AND SWIRLER

BACKGROUND

Embodiments of the subject matter disclosed herein relates primarily to methods for reducing NOx emissions in a gas turbine.

In the last years it has become particularly desirable a reduction of gas turbines pollutant emissions, in particular on NOx emissions; more in detail such reduction is particularly needed as a consequence of increasingly stringent government regulation on that matter.

Over the time, in this field, many solutions have been explored in order to reduce the NOx emission; one solution that seems to give good result is the so called "Lean combustion" (i.e. when fuel to air equivalence ratio is kept far below stoichiometric), that represents an effective strategy when flame temperature is properly controlled.

Nevertheless, it is still possible that a given combustor fuel/air mixture is not optimal due to suboptimal mixing profiles resulting from the fuel nozzle hardware: regions of non-ideal mixing can then occur and hot spots can manifest in the combustor, leading to localized near-stoichiometric combustion regions, thus leading to a worsening in the NOx emissions.

In the known art, in order to promote homogenous fuel/air mixing, swirl stabilized fuel/air mixers have been employed in the gas turbine industry; a particular kind of known air fuel mixer is the one that comprises a dual annular counter rotating swirler (also indicated as DACRS), as shown in FIGS. 1, 2 and 3.

This air fuel mixer 100 comprises two co-axial annular chambers, one outer chamber 101 and one inner chamber 102; in each chamber a certain number of blades 103, 104 is provided, thereby forming a so-called "swirler": an inner swirler 105 and an outer swirler 106.

Due to the different shape of the blades 103 and 104 of the two swirler 105, 106, at the air flux 107 entering the swirler it is imparted a counter-rotation motion.

The flow of air is then mixed with a flow of fuel (particularly, gas) 108 injected in the chamber 101 of the outer swirler 105: due to the shear layer generated by the counter-rotating swirler 105, 106, high turbulence levels are promoted and are able to improve fuel/air mixing in spite of the low available mixing duct length.

The fuel flow 108 is injected in a transverse direction with respect to the axis of rotation of the swirler, in the vanes between adjacent blades 103 of the outer swirler 105, as can be appreciated in FIG. 3.

Other known solution are those described in U.S. Pat. No. 5,251,447, in which a DACRS is used, and the fuel is injected axially (in a direction parallel to the axis of rotation of the swirlers) inside the outer chamber.

Another known solution is the one shown in U.S. Pat. No. 5,351,447, in which, in an air fuel mixer provided by a DACRS, the fuel is supplied both in the outer chamber and, sprayed axially, at the intersection of the inner and outer swirlers, downstream of the latter.

Trying to summarize, the main aim of the known solutions, is to improve the air fuel mixing action, in those areas in which the localized near-stoichiometric combustion regions are present: in this sense, a criteria that seems to be in common, in the known solutions, is to improve this mixing action in the outer part of the mixer, where the undesired regions of non-ideal mixing and hot spots are present.

Although those known solutions are in general effective, an even further reduction in NOx emission is desirable.

Moreover, those kind of known air fuel mixer are particularly sensitive to manufacturing variability, since the working tolerances can strongly impact on the overall performance of the mixer; it can happen that in the same lot of air fuel mixer made by the same manufacturer, high differences in terms of performance between one mixer and another is shown, thus high refurbishing costs.

SUMMARY

To achieve a further better reduction in NOx emissions, when using an air fuel mixer provided by a dual annular counter rotating swirler, an important idea is to inject the flow of fuel in the inner chamber of the internal swirler.

According to a further enhancement, another important idea is to inject the flow of fuel solely in the inner chamber of the internal swirler, therefore depriving the outer swirler of any fuel (gas) injection.

First embodiments of the subject matter disclosed herein correspond to a method for reducing NOx emissions in a gas turbine in which a flow of primary air and a flow of fuel are fed into a dual annular counter rotating swirler, said primary air flow being fed into the inner and outer annular chambers of the swirler, the method further comprising the step of injecting the flow of fuel into the inner annular chamber.

It has been discovered, and tested, that by feeding the inner chamber of the dual annular counter rotating swirler enhances the mixing action between fuel and air and allows for a NOx reduction.

Second embodiments of the subject matter disclosed herein correspond to an air fuel mixer for gas turbine, comprising a primary air duct for supplying primary air, a fuel duct for supplying fuel, particularly gas, a dual annular counter rotating swirler, that on its turn comprises one inner swirler and one outer swirler co-axial each other; said air fuel mixer further comprises a fuel supplying element operatively connected to said fuel duct, said fuel supplying element being adapted to supplying fuel inside said inner chamber.

In this way, said air fuel mixer for gas turbine is suitable for performing the method above described, with the relevant advantages related to the NOx reduction.

As will be described more in detail in the following description, another important advantage of an embodiment is achieved by the air fuel mixer according to the subject matter herein disclosed, is that such a mixer is less sensitive to manufacturing variability, and differences in terms of performance between one mixer and another of the same lot are reduced.

A third embodiment comprises a gas turbine comprising an air fuel mixer according to the second embodiment.

A fourth embodiment comprises a dual annular counter rotating swirler, comprising one inner swirler and one outer swirler co-axial each other and respectively comprising an inner chamber housing inner blades and an outer chamber housing outer blades, wherein the swirler comprises fuel supplying elements adapted for supply fuel inside said inner chamber.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

Figure 1:
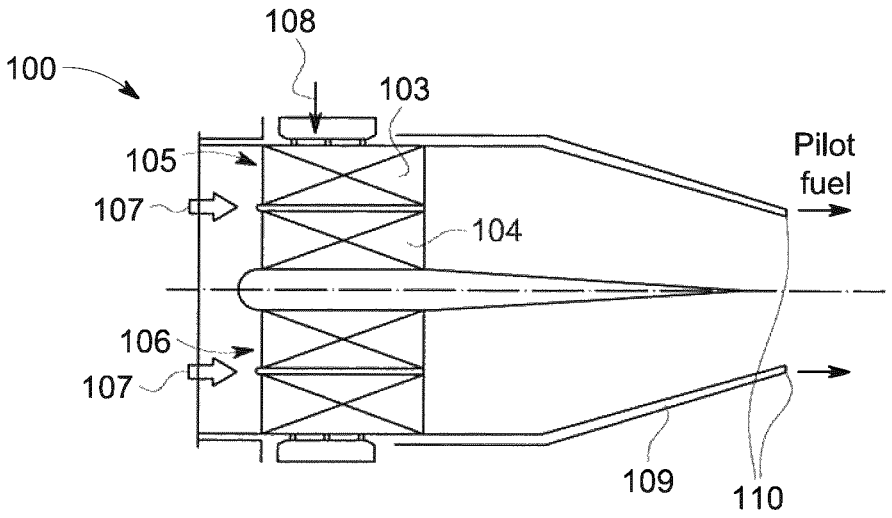
FIG. 1 PRIOR ART
FIG. 1 shows a cross-section of an air fuel mixer according to known art.
Figure 2:
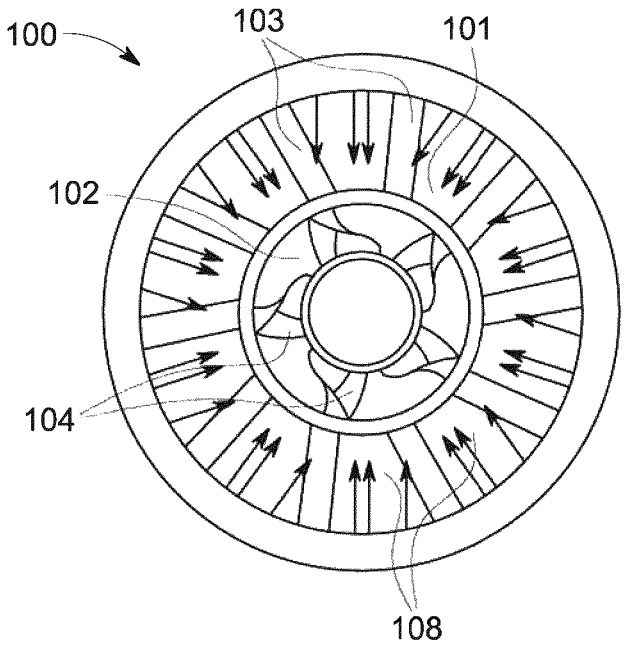
FIG. 2 PRIOR ART
FIG. 2 shows a front view of an air fuel mixer according to known art.
Figure 3:
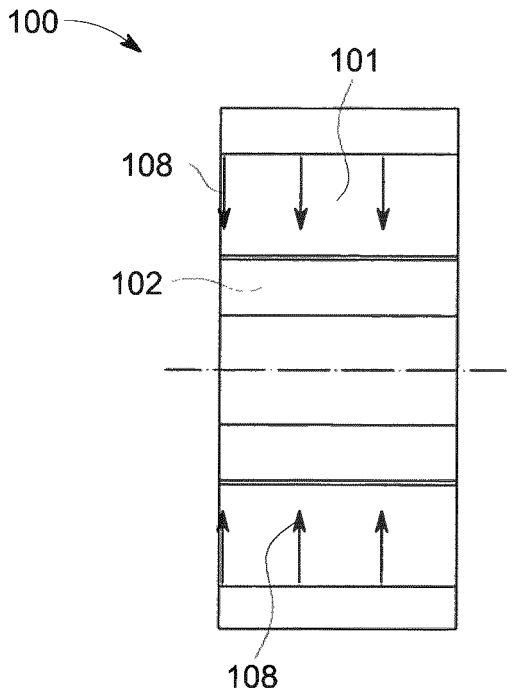
FIG. 3 PRIOR ART
FIG. 3 shows a cross-section of a detail of the mixer of FIG. 1.

The following description of exemplary embodiments refers to the accompanying drawings.

The following description does not limit the invention. Instead, the scope of the invention is defined by the appended claims.

Reference throughout the specification to "one embodiment" or "an embodiment" element that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

One embodiment of the subject matter herein disclosed is a method for reducing NOx emissions in a gas turbine in which a flow of primary air and a flow of fuel (gas) are fed into a dual annular counter rotating swirler, said primary air flow being fed into both the inner and outer annular chambers, and it is provided to inject the flow of fuel into the inner annular chamber.

This method allows for a better mixing action and a reduction in NOx, since the fuel can be injected in the whole mass of air entering the swirler.

According to an improvement in that method, it is provided to inject the flow of fuel within the dual annular counter rotating swirler, solely into the inner chamber, thereby depriving the outer chamber of any fuel injection or supply.

The term "within" the swirler is used for indicating an area "upstream" the end of the swirler with reference to the air flow direction from the inlet to the outlet; the term "end of the dual annular counter rotating swirler" indicate the section (perpendicular to the axis of the swirler) of the mixer in which the blades of the swirler ends.

It must be noted that, downstream of the end of the swirler, there can be other fuel injection points in the flow of air, for example if pilot fuel is used: those others fuel injection, in any case, are outside the swirler, particularly downstream the end of the swirler itself.

Particularly, according to the test result (with reference to FIGS. 8 and 9) it has shown that, thanks to the injection of fuel solely (when considering the area upstream of the end of the swirler itself) in the inner chamber of the swirler, an even better mixing action between fuel and primary air is obtained, so that an optimal fuel concentration profile can be reached, that avoid hot spot or localized near-stoichiometric combustion regions and, therefore, a reduction in NOx emissions: the rich peak has been found moved toward the axis. This allows to have a leaner mixture interacting with the pilot diffusive combustion modality, and lead to have a positive influence of NOx reduction.

It has shown to be particularly interesting to inject the flow of fuel, at least at an injection point in the inner chamber, said injection point being located adjacent to the outer annular chamber: in this way the fuel is injected in the vicinity of the intense shear region between the inner and outer swirler and the strong turbulence helps in an even better fuel air mixing.

To this extent it would be interesting to inject the fuel at the dividing hub between the inner swirler and the outer swirler, on the side of the inner swirler.

In an embodiment, there is a plurality of injection points located in this way; in particular, a very advantageous solution is to provide two fuel injection points for each vane defined by two adjacent blades of the inner swirler; in this way, the whole fuel flow (for each inner vane) can be sub-divided in two parts for better results in mixing with air.

In that case, it is optionally and advantageously provided to have, for each vane of the inner chamber, an injection of a first flow of fuel that is greater than an injection of a second flow of fuel; particularly, for each vane of the inner chamber, the first flow of fuel is injected near the inlet section of the swirler (i.e. where the swirler blades begin), while the second flow of fuel is injected near the outlet section of the swirler (where the swirler blades end) of the swirler.

Although it would be in principle possible to inject the fuel in the inner chamber in a variety of ways, it has been found that a particularly advantageous solution is to inject the flow of fuel in a transverse direction with respect to a swirler axis and toward it. The direction of the flow of fuel is consequently centripetal.

The supplying path for feeding such fuel into the inner chamber can vary, but tests have shown that it would be particularly interesting to supply the fuel into the inner chamber at least through a transverse supplying path passing in the outer chamber and ending in the inner chamber.

In this way, it is possible to feed each inner vane defined between two adjacent blades of the inner swirler by at least one transverse supplying path, or, in an alternative solution, by two transverse supplying paths.

It must be noted that, in principle it would be also possible to have also three, four or more supplying paths and/or injection points for each vane of the internal chamber, although augmenting their number would be subjected to balance with the need for a relatively simply construction.

In an embodiment, when each outer blade 62 is provided by one supplying pipe (either the first one or the second one), outer blades 62 having a first supplying pipe 71 are alternated with outer blades having a second supplying pipe 72; the first supplying pipes 71 have a larger passage area than the second supplying pipes 72; all the first supplying pipes 71 are aligned on a first common plane and all the second supplying pipes 72 are aligned on a second common plane, the first plane being nearer the air inlet of the swirler than the second plane. Since in this embodiment the number of outer blades is double than the number of inner blades, for each inner vane two supplying pipes are provided, particularly one first supplying pipe 71 and one second supplying pipe 72.

Figure 5:
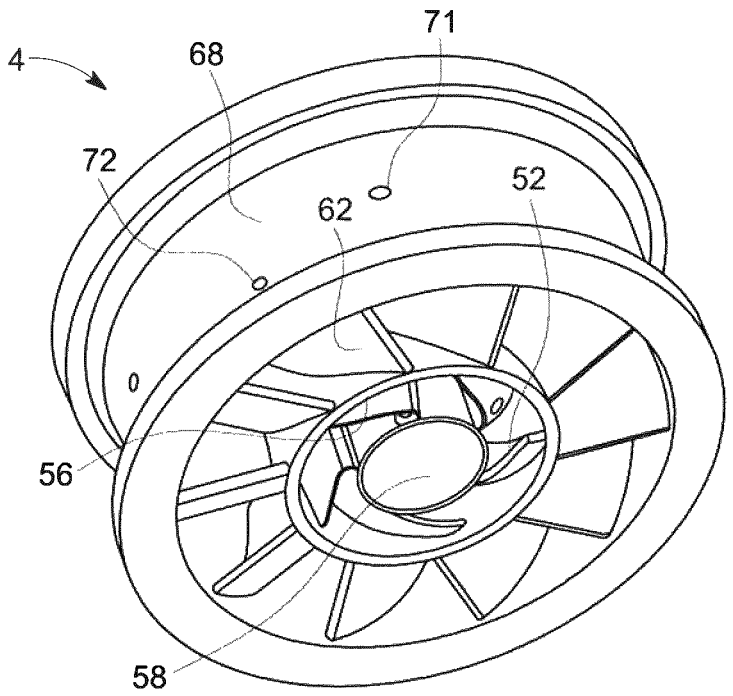
FIG. 5 shows a perspective view of a dual annular counter-rotating swirler comprised in the mixer of the embodiment of FIG. 4, FIGS. 6 and 7 show sectional views of the dual annular counter-rotating swirler of FIG. 5, taken along two different sectional planes.

Another embodiment of the subject matter herein disclosed is an air fuel mixer, described in the following with reference to FIG. 5-7.

The air fuel mixer 1 for gas turbine, comprises a primary air duct 2 for supplying primary air and a fuel duct 3 for supplying fuel, particularly gas.

It has to be understood that, in the accompanying figures, such ducts 2 and 3 are drawn only for illustrative purposes and their shape or position can vary according to the circumstances; for example the fuel duct 3 can be simply in the form of a manifold suitable for being coupled to a fuel supply line (not shown) of the plant.

The air fuel mixer 1 comprises a dual annular counter rotating swirler 4; it is not important to the extent of the advantages in NOx reduction, if such dual annular counter rotating swirler is of the axial, radial or axial/radial type.

Figure 6:
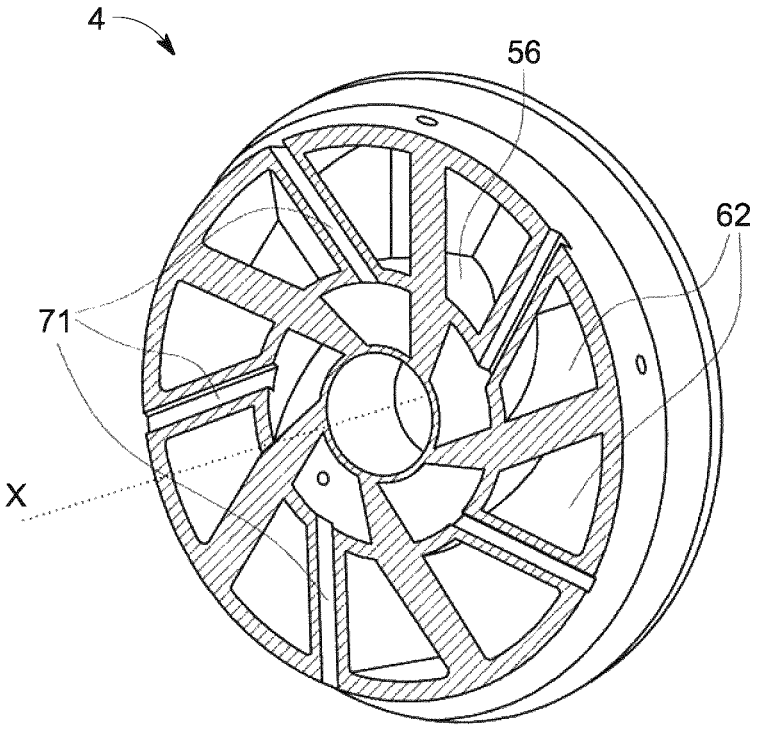
Figure 7:
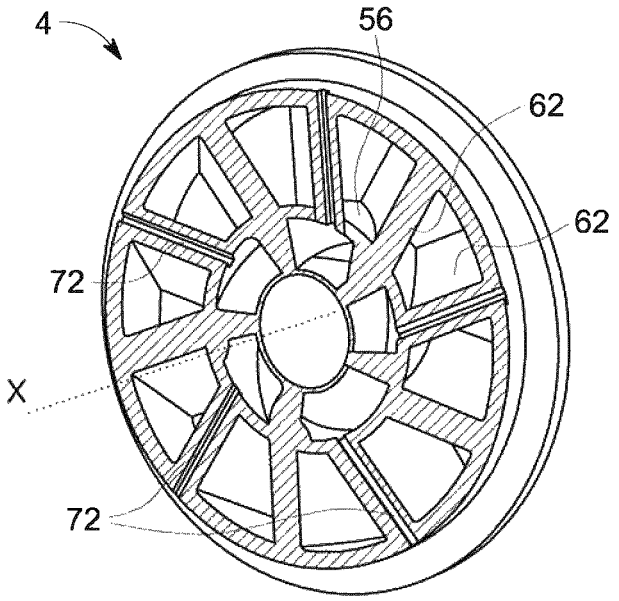

Such swirler 4 comprises one inner 5 and one outer 6 swirler, co-axial each other, around the axis X as shown in FIGS. 6 and 7.

The inner swirler 5 is housed inside the outer swirler 6, being of a reduced diameter with respect to the latter.

The inner swirler comprises one annular inner chamber 51 and inner blades 52 housed in said inner chamber 51.

The outer swirler 6, concentric with the inner one 5, comprises on its turn an annular outer chamber 61 and outer blades 62 housed in said outer chamber 61.

The primary air duct 2 is operatively connected (or in flow communication) with the inner swirler 5 and the outer swirler 6; the flow of primary air is therefore ideally subdivided in two counter-rotating fluxes thanks to the different shape and orientation of the inner and outer blades 52, 62.

The inner and outer chambers 51, 61 are both defined in part by the dividing hub 56; the outer chamber 61 is then defined also by the external hub 68, while the inner chamber 51 is defined also by the internal hub 58.

Inner blades 52 therefore are coupled (by way of example a monolithic with) the internal hub 58 and the dividing 56 hub, while outer blades are coupled (by way of example a monolithic with) the dividing hub 56 and the external 68 hub.

According to the embodiment herein disclosed, the air fuel mixer 1 further comprises a fuel supplying element operatively connected to said fuel duct 3, said fuel supplying element being adapted to supplying fuel inside the inner chamber 51.

According to particularly advantageous embodiment, the outer chamber 61 is deprived of any fuel injecting element.

In other words, within (in the sense of "upstream the end of") the swirler the fuel supplying element consists of at least one pipe (or duct) operatively connected to the duct 3 and ending (opened) in the inner chamber 51, for supplying fuel only in said inner chamber 51; opening of the fuel supplying element in the inner chamber can therefore be considered as an "injection point".

In this way, the fuel supplying element defines the fuel supplying path for feeding such fuel into the inner chamber.

In an embodiment, but not limiting embodiment, the fuel supplying element comprises a first transverse fuel supplying pipe 71 and a second transverse fuel supplying pipe 72 in two different and adjacent blades 62 of the outer swirler 6; in this way, there is obtained a transverse fuel supplying path.

The term "transverse" is used here for indicating a direction substantially resting on a plane that has the axis X of the swirler as a perpendicular line.

More in general, according to the subject matter, there can be a different number of fuel supplying pipe for supplying fuel in the inner chamber 51: only one fuel supplying pipe, two, three or more fuel supplying pipe, also shaped in a different way with respect to those of the figures or even not housed inside the blades 62, but, for example provided as dedicated ducts passing near the blades (or in other positions in which, in some embodiments, they do not interfere with the rotation imparted to the primary air flow by the blades of the swirler 4).

In the advantageous embodiment shown in the appended figures, the first and second transverse fuel supplying pipes 71, 72 are housed at least in part, in some embodiments completely, inside the outer blades 62, as can be best seen in FIGS. 6 and 7.

Each fuel supplying pipe 71, 72 is provided by an inlet located on the external hub 68 and an outlet located on the dividing hub 56 on the inner chamber side of the latter: in this way, in use, each fuel supplying pipe 71, 72 can be fed through the inlet (operatively connected with the fuel duct 3) and injects fuel in the inner chamber 51 by the outlet on the dividing hub 56.

In an embodiment, the fuel supplying pipes 71, 72 provide a transverse path with respect to the axis X of the swirler (see FIGS. 6 and 7).

In the advantageous embodiment shown in the appended figures, there is a plurality of first fuel supplying pipes 71 (shown in the cross section of FIG. 6) all aligned on a common first plane, and a plurality of second fuel supplying pipes 72 (shown in the cross section of FIG. 7) all aligned on a common second plane. Both the first and second common planes are parallel (and distinct) to each other and are perpendicular to the axis X of the swirler.

In an embodiment, each fuel supplying pipe 71, 72 is shaped as a straight hole in the outer blade, the axis of said hole being substantially tangential with respect to the internal hub 58.

The term "substantially tangential" is used herein for indicating that the direction referred to is not properly "tangential" to the hub itself—since the outlet must open in the hub 56—but has an orientation very close to the tangential one, for example forming an angle comprised between 10-15° with the direction tangential to the internal hub 58.

In another different embodiment, each fuel supplying pipe 71, 72 is shaped as a straight hole in the outer blade, the axis of said hole being substantially radial with respect to the dividing hub 56.

The embodiment in which the fuel supplying pipe is a straight hole in the outer blade has shown interesting advantages for what concern the sensibility to manufacturing processes: realizing straight hole with a certain diameter is nevertheless quite a simple operation with reduced errors in manufacturing, thus leading to more predictable result in term of finishing and precision dimensioning.

In the advantageous embodiment shown in the appended figures, the diameters of the first and second supplying pipes 71, 72 are different, one being larger than the other one; particularly, the fuel supplying pipe 71 having its outlet nearer the primary air inlet has the larger diameter; this allows to feed the major part of fuel flow nearer the air inlet and obtain a better mixing. The diameters are comprised between 1.8 and 2.0 mm, in an embodiment 1.4 mm More in general, it can be said that, if the first and second transverse fuel supplying pipe 71, 72 are not circular, then, the first transverse fuel supplying pipe 71 has a passage area bigger than the second transverse fuel supplying pipe passage area.

The air fuel mixer 1 can further comprise, as shown, a converging duct 19 as well as a coaxial pilot on air fuel mixer tip.

Figure 4:
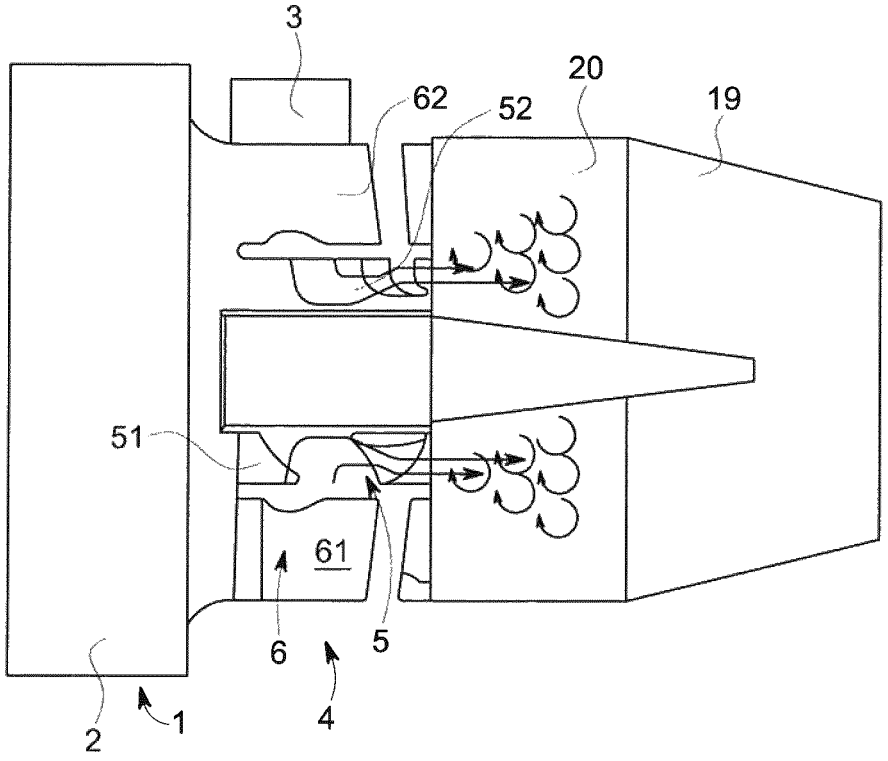
FIG. 4 shows a cross-section of an air fuel mixer according to an embodiment of the present invention.

An additional, though optional, feature is to provide, immediately downstream of the end of the swirler 4, a cylindrical portion of the duct 21, immediately upstream of the converging duct 19, as shown in FIG. 4.

Since pilot are provided on the fuel mixer tip (at the end of the converging duct 19), the effect of the cylindrical portion of the duct 21 is to allow a certain residence time for the air and fuel mix, so as to enhance further the mixing of the two before their arrival to the pilot and the combustion.

Figure 8:
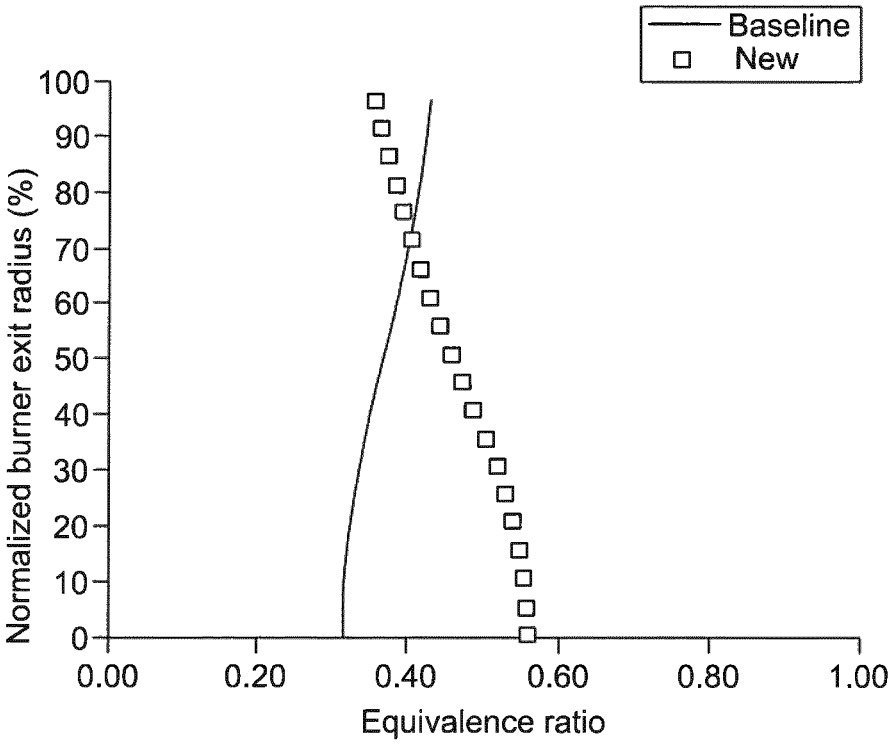
FIG. 8 shows a fuel concentration profiles comparison between the air fuel mixer of FIG. 4 and known mixers.
Figure 9:
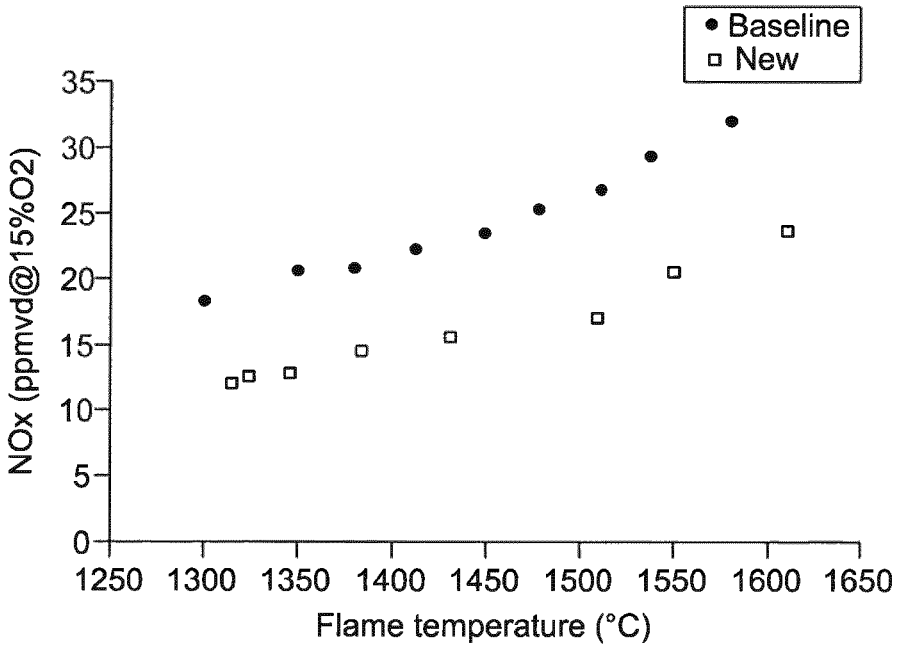
FIG. 9 shows NOx emission comparison between the air fuel mixer of FIG. 4 and known mixers.

Finally, when looking at the tests results of FIG. 8, one can immediately appreciate the fuel concentration profile between one known solution (continuous black line) and the the one herein disclosed (white squares); this allows, briefly, to gain the advantages in terms of NOx reduction that are well apparent from FIG. 9; in the latter a visual comparison between a known solution (black dots) and the present one (white squares) of NOx emissions in relation to the flame temperature clearly shows the achieved reduction.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

What is claimed is:

1. A method for reducing NOx emissions in a gas turbine, the method comprising:

feeding a flow of primary air and a flow of fuel into an air fuel mixer equipped at least by a dual annular counter rotating swirler having a radially inner chamber and a radially outer chamber, wherein the inner and the outer chamber are coaxial and separated by a dividing hub, and wherein the inner and outer chamber are configured to generate a fuel and air mixture having a counter rotating swirling motion about a swirler axis; and injecting along a transverse direction the flow of fuel only into the inner chamber of the swirler via a fuel supplying path extending in the transverse direction, the fuel supplying path including a first injection port configured as a fuel inlet located on an outer circumferential surface of an annular external hub arranged radially outward to enclose the outer chamber, and a second injection point configured as a fuel outlet located on an inner circumferential surface of the dividing hub between the inner and outer chamber, the fuel outlet configured to directly inject the fuel into the inner chamber in order to mix with the primary air therein, wherein the transverse direction is perpendicular to the swirler axis.

2. The method of claim 1, wherein the flow of fuel is fed into the inner chamber at least through the fuel supplying path passing through the outer chamber and ending in the inner chamber.

3. The method of claim 2, wherein the dual annular counter rotating swirler comprises inner blades housed in the inner chamber and outer blades housed in the outer chamber, and each of the inner blades is provided with at least one fuel supplying path.

4. An air fuel mixer for a gas turbine, the air fuel mixer comprising:

a primary air duct for supplying primary air, a dual annular counter rotating swirler comprising a radially inner chamber and a radially outer chamber, wherein the inner and the outer chamber are coaxial and separated by a dividing hub, and an annular external hub is arranged radially outward to enclose the outer chamber, a fuel duct for supplying fuel extending in a transverse direction, a fuel supplying element operatively connected to the fuel duct and the dividing hub, the fuel supplying element including a first injection port configured as a fuel inlet located on an outer circumferential surface of the external hub, and a second injection point configured as a fuel outlet located on an inner circumferential surface of the dividing hub between the inner and outer chamber, wherein the primary air duct in flow communication with the inner chamber and the outer chamber, and wherein the inner and outer chamber are configured to generate a fuel and air mixture having a counter rotating swirling motion about a swirler axis, and the fuel outlet configured to directly inject, along the transverse direction, the fuel only inside the inner chamber in order to mix with the primary air therein, wherein the transverse direction is perpendicular to the swirler axis.

5. The air fuel mixer of claim 4, wherein the fuel supplying element comprises at least one pipe operatively connected to the fuel duct and ending in the inner chamber.

6. The air fuel mixer of claim 5, wherein the fuel supplying element passes at least in part through the outer chamber.

7. The air fuel mixer of claim 5, wherein the at least one pipe has a diameter comprised between 1.8 and 2.0 mm.

8. The air fuel mixer of claim 4, wherein the outer chamber comprises outer blades and the fuel supplying element comprises a first transverse fuel supplying pipe.

9. The air fuel mixer of claim 8, wherein the fuel supplying element further comprises a second transverse fuel supplying pipe housed at least in part inside the outer chamber.

10. The air fuel mixer of claim 9, wherein the first transverse fuel supplying pipe is near to the primary air duct and the second transverse fuel supplying pipe is remote from the primary air duct, the first transverse fuel supplying pipe having a passage area bigger than the second transverse fuel supplying pipe passage area.

11. A gas turbine comprising an air fuel mixer according to claim 4.

12. A dual annular counter rotating swirler, the dual annular counter rotating swirler comprising:

one radially inner swirler and one radially outer swirler configured to receive a flow of primary air and a flow of fuel to generate a fuel and air mixture having a counter rotating swirling motion about a swirler axis and respectively comprising an inner chamber housing inner blades and an outer chamber housing outer blades, and an annular external hub is arranged radially outward to enclose the outer chamber, wherein the dual annular counter rotating swirler comprises a plurality of fuel supplying elements extending along a transverse direction and configured to supply fuel only to the inner chamber, wherein the inner and the outer chamber are separated by a dividing hub, wherein a first injection port configured as a fuel inlet of each of the plurality of fuel supplying elements is located on an outer circumferential surface of the external hub, and a second injection point configured as a fuel outlet of each of the plurality of fuel supplying elements is located on an inner circumferential surface of the dividing hub between the inner and outer chamber, each fuel outlet configured to directly inject the fuel into the inner chamber in order to mix with the primary air therein, wherein the transverse direction is perpendicular to the swirler axis.

13. The dual annular counter rotating swirler of claim 12, wherein each of the fuel supplying elements comprises at least one pipe operatively connected to a fuel duct and ending in the inner chamber.

14. The dual annular counter rotating swirler of claim 13, wherein the at least one pipe has a diameter comprised between 1.8 and 2.0 mm.

15. The dual annular counter rotating swirler of claim 12, wherein each of the fuel supplying elements passes at least in part through the outer chamber.

16. The dual annular counter rotating swirler of claim 12, wherein the fuel supplying element comprises a first transverse fuel supplying pipe.

17. The dual annular counter rotating swirler of claim 12, wherein each of the fuel supplying elements comprises a pipe, each pipe has an opening in the inner chamber at the dividing hub.

18. The dual annular counter rotating swirler of claim 12, wherein each of the plurality of fuel supplying elements is a straight hole through a respective blade of the outer blades that is tangential with respect to the dividing hub.

* * * * *